US006358905B1

(12) United States Patent
Render et al.

(10) Patent No.: US 6,358,905 B1
(45) Date of Patent: Mar. 19, 2002

(54) BLEACH CATALYSTS

(75) Inventors: Carmel M. Render, Hampton; Michael J. Greenhill-Hooper, Petworth, both of (GB); Clifford A. Bunton, Santa Barbara, CA (US)

(73) Assignee: U.S. Borax Inc., Valencia, CA (US)

( * ) Notice: Subject to any disclaimer, the term of this patent is extended or adjusted under 35 U.S.C. 154(b) by 0 days.

(21) Appl. No.: 09/554,457

(22) Filed: Jul. 7, 2000

(30) Foreign Application Priority Data

Nov. 14, 1997 (GB) ..... 9724164
Apr. 21, 1998 (GB) ..... 9808332

(51) Int. Cl.[7] ..... C11D 3/395
(52) U.S. Cl. ..... 510/376
(58) Field of Search ..... 510/376

(56) References Cited

U.S. PATENT DOCUMENTS 4,100,095 A 7/1978 Hutchins et al.
4,412,934 A 11/1983 Chung et al.
4,536,319 A * 8/1985 Payne ..... 252/174.17

FOREIGN PATENT DOCUMENTS

DE 196 05 688 A1 8/1997
DE 196 13 103 A1 10/1997
DE 196 28 809 A1 1/1998
EP 0136844 A2 4/1985
EP 0237111 A2 9/1987
EP 0272030 A2 6/1988
EP 0380437 A2 8/1990
EP 0392592 A2 10/1990
EP 0443651 A2 8/1991
EP 0458397 A2 11/1991
EP 0458398 A2 11/1991
EP 536939 A1 * 4/1993
EP 0600359 A2 6/1994
WO WO 96/23859 A1 8/1996
WO WO 96/23860 A1 8/1996
WO WO 96/23861 8/1996

OTHER PUBLICATIONS

Hage, Ronald et al., "Efficient Manganese Catalysts for Low Temperature Bleaching", Nature, vol. 369, pp. 637–639, Jun. 1994.

* cited by examiner

*Primary Examiner*—John Hardee
(74) *Attorney, Agent, or Firm*—Kurt R. Ganderup

(57) ABSTRACT

The invention relates to bleach catalysts for use in cleaning or detergent compositions. The bleach catalysts used are water-soluble complexes of (a) one or more cobalt ions and, as ligand, (b) one or more aminated and/or alkylated mono- or oligo-saccharides, optionally in reduced or oxidized form, and salts thereof. The complexes according to the invention are good bleach catalysts and have high hydrolytic stability.

15 Claims, No Drawings

BLEACH CATALYSTS

This invention relates to bleach catalysts for use in cleaning or detergent compositions.

European laundry detergents usually contain oxygen-based bleaching agents such as sodium perborate or sodium percarbonate. These bleaches work well at temperatures above 60° C., but to boost their overall effectiveness at today's relatively low washing temperatures (e.g. 40–60° C.), they are most commonly employed with so-called bleach activator compounds. The bleach activator, an example in commercial use of which is tetraacetylethylenediamine (TAED), is typically employed at a level of 3–6% in the detergent and reacts stoichiometrically with the persalt to yield a stronger oxidising agent, e.g. peracetic acid. This oxidant is better able to bleach stains than hydrogen peroxide and also has superior biocidal activity. However, as washing temperatures continue to decline, as a result of the demand for greater energy efficiency, even the commercially used activated bleach systems are becoming less attractive since their performance is known to decrease rapidly below 40° C. Another drawback of these types of activator is their significant cost contribution to the detergent formulation, especially in proportion to that of the persalt component. Their rate of dissolution at low temperatures is also likely to reduce their effectiveness and may cause localised dye damage.

The development of interfacially active bleach activators, which react with persalts to produce peracids which are in turn interfacially active, has improved the performance of oxygen bleaches under certain conditions. The technology has meant that lower concentrations of the bleach system in the wash liquor are needed to give equivalent performance since the bleach is effectively targeted to the stains. Sodium nonanoyloxybenzene sulphonate (SNOBS) as described in U.S. Pat. No. 4,412,934, is an example of this type of activator. Although this disclosure has resulted in the successful introduction of perborate bleach-based detergents into the United States, where lower detergent concentrations are typically employed, it has done little to improve detergent performance at temperatures below 40° C.

Much effort is being expended in the search for new organic bleach activators, however at present none has emerged which fulfils all the requirements, which must include (I) significantly improved bleach activity below 40° C., (II) fast dissolving rate, (III) low cost, (IV) ease of processability into detergent formulations, (V) storage stability, (VI) compatibility with other detergent ingredients, and (VII) a non-toxic nature.

Another approach considered has been the use of pre-formed peracids as bleaches. An example of this is diperoxydodecanedioic acid (DPDDA). Although this, and other examples of pre-formed peracids, can lead to better bleaching performance than tetracetylethylenediamine (TAED) activated perborate, the peracids generally need stabilising coatings (as described for example in U.S. Pat. No. 4,100,095). Their use can also cause pin-hole damage to dyed fabrics.

Yet another approach taken within the detergents industry has been the use of bleach catalysts which work with oxygen bleaches such as sodium perborate or sodium percarbonate. EP-A-237,111 and EP-A-443,651 describe bleaching compositions comprising a water soluble complex of manganese with a multidentate ligand, such as hydroxycarboxylic acid and non-carboxylate polyhydroxy compounds respectively. EP-A-272,030 and EP-A-392,592 disclose Co(III)amine complexes (e.g. $[Co(NH_3)_5Cl]Cl_2$) and Co(bispyridylamine)$Cl_2$ complexes respectively, as effective catalysts for activating hydrogen peroxide compounds in removing stains from substrates, such as fabrics. Other patent specifications, for example WO 96/23859, WO 96/23860 and WO 96/23861, disclose cobalt catalysts such as $[Co(NH_3)_5Cl]Cl_2$ and Co-SALEN type complexes to provide enhanced cleaning/bleaching benefits in automatic dishwashing detergents. Catalysts described by Rage et.al. in Nature 369, 637–639 (1994) and also in EP-A-458,397 and EP-A-458,398 are examples which give a considerable enhancement to persalt bleaching of stains on fabrics during washing at temperatures below 40° C. However, these catalysts are prone to causing unacceptable dye and fabric damage due to the formation of radical catalyst decomposition products.

Another important characteristic of bleach catalysts is their hydrolytic stability. Lack of hydrolytic stability of the catalysts can result in precipitation out, under alkaline wash conditions, of insoluble transition metal oxides or hydroxides resulting in most undesirable brown staining. It is thus important that the complex employed as catalyst must have good hydrolytic activity on the one hand but still have good effectiveness as bleach catalysts on the other hand.

It has now surprisingly been found that water-soluble complexes of cobalt with aminated and/or alkylated mono- or oligo-saccharides, optionally in reduced or oxidised form, and salts thereof have high effectiveness as bleach catalysts and have high hydrolytic stability.

According to one aspect of the present invention, there is provided a water-soluble complex of (a) one or more cobalt ions and, as ligand, (b) one or more aminated and/or alkylated mono- or oligo-saccharides, optionally in reduced or oxidised form, and salts thereof for use as a bleach catalyst, in particular for a cleaning or detergent composition.

Suitably, in the complex used according to the present invention the cobalt ion(s) (a) is/are complexed with (b) one or more compounds of the general formula I (I)

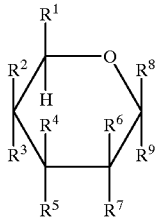

wherein $R^1$ is selected from $CH_2OH$, $CO_2H$, $CO_2^{\ominus}M^{\oplus}$ (wherein M is an alkali metal or ammonium ion) and groups of the formula (a) to (d)

(a)

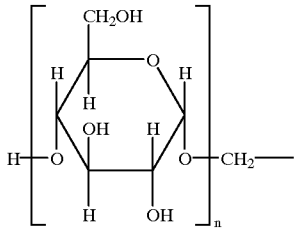

-continued (b)

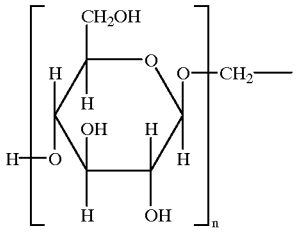

(c)

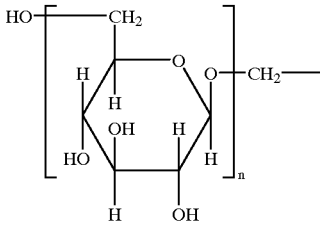

(d)

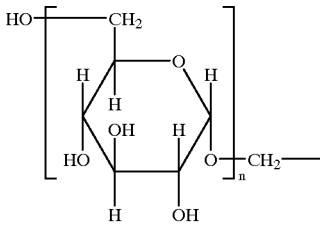

and n is an integer from 1 to 3;

one of $R^2$ and $R^3$ is H and the other is selected from H, OH and groups of the formula (e) to (h)

(e)

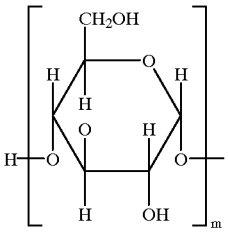

(f)

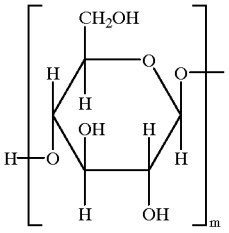

(g)

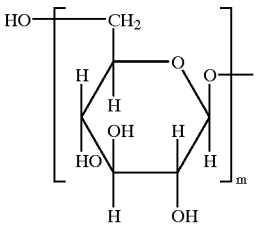

-continued (h)

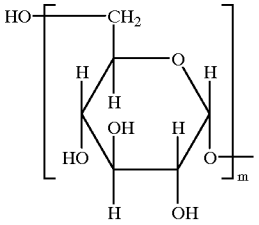

and m is an integer from 1 to 3;

one of $R^4$ and $R^5$ is H and the other is OH;

one of $R^6$ and $R^7$ is H and the other is OH or $NH_2$; and one of $R^8$ and $R^9$ is H and the other is OH, $OCH_2(CH_2)_pCH_3$ (wherein p is an integer from 6 to 16), or a group of the formula

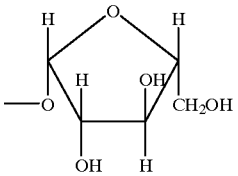

provided that one of $R^6$ and $R^7$ is $NH_2$ and/or one of $R^8$ and $R^9$ is $OCH_2(CH_2)_pCH_3$.

Also in the complex used according to the present invention, the cobalt ion(s) (a) may be complexed with (b) one or more compounds of the general formula II $$R^{10}[C_1H_{21-k}(OH)_k]\underset{\underset{NH_2}{|}}{C}HR^{11} \qquad \text{(II)}$$

wherein each of $R^{10}$ and $R^{11}$, which may be the same or different, represents H, $CH_2OH$, $CO_2H$ or $CO_2^{\ominus}M^{\oplus}$ (wherein M is as defined above); and each of l and k is an integer of 2 to 5 and k is equal to or less than l.

Preferably the cobalt ion(s) (a) is/are complexed with (b) D-mannosamine, D-glucosamine, or D-galactosamine, or with (b) one or more alkyl polyglucosides having a degree of polymerisation up to 5 and wherein the alkyl groups contain 8 to 18 carbon atoms.

Suitably the complex used according to the invention is a Co(II) or a Co(III) complex.

The complexes used according to the invention may be prepared by a method which comprises contacting in aqueous solution (A) a water-soluble compound capable of releasing Co(II) or Co(III) ions on addition to water with (B) one or more aminated and/or alkylated mono- or oligosaccharides, optionally in reduced or oxidised form, and salts thereof.

For example, cobalt chloride hexahydrate (0.53 g) and mannosamine hydrochloride (24.1 g) were dissolved in 500 ml of demineralised water, the pH of the solution was adjusted to 10 using 1M sodium hydroxide solution and the solution was evaporated to dryness in a rotary evaporator.

The molar ratio of the ligand to cobalt may generally be between 1:1 and 500:1 with ratios in the region 50:1, e.g. 20:1 to 80:1 being particularly suitable.

According to another aspect of the present invention there is provided a cleaning or detergent composition comprising:

(I) a bleaching agent, and (II) as bleach catalyst, a water-soluble complex as defined according to the present invention.

The cobalt bleach catalyst can, and indeed is preferably, formed in situ at the beginning of the wash cycle. Accordingly, according to a further aspect of the invention, there is provided a cleaning or detergent composition comprising:

(I) a bleaching agent, and, as precursors for a bleach catalyst, (IIA) a water-soluble compound capable of releasing Co(II) or Co(III) ions on addition to water, and (IIB) one or more aminated and/or alkylated mono- or oligo-saccharides, optionally in reduced or oxidised forms, and salts thereof.

The water-soluble $Co^{2+}$ or $Co^{3+}$ compound (IIA) should be a compound which complexes preferentially with the compounds (IIB) in the composition. These compounds may be cobalt chloride or weakly complexed cobalt compounds.

The complexes used according to the invention promote bleaching activity and this is particularly noticeable at low temperatures (i.e. 20 to 40° C.).

The bleaching agent (I) will generally be a peroxy compound which liberates hydrogen peroxide in water, preferably sodium perborate or sodium percarbonate.

The ligand component of the bleach catalyst (b) or precursor ingredient (IIB) may suitably be a cyclic ligand of formula I. Some of the ligands of formula I have surface active properties which provide further cleaning benefits towards oily and particulate solids in particular.

The ligand compounds used according to the invention are derived from starches or naturally occurring carbohydrates and thus are environmentally acceptable and toxicologically inert.

The compositions according to the invention may be laundry detergents or hard surface cleaners including automatic dishwashing detergents and may comprise other ingredients well known to those skilled in the art.

They may contain a bleach activator e.g. TAED.

The compositions according to the invention may contain a surfactant, for example, an anionic surfactant such as an alcohol sulphate or linear alkyl benzene sulphonate or non-ionic such as an alcohol ethoxylate.

In addition, the compositions according to the invention will generally contain builders such as alumino-silicates (e.g. zeolite A), layered silicates, phosphates particularly sodium tripolyphosphate, trisodium citrate, sodium carbonate or sodium borate.

Equally, there may be present polymeric additives such as maleic/acrylic copolymers which act as co-builders, and soil release polymers such as polyethylene oxide terephthalate.

The compositions according to the invention may also contain suds suppressors such as soap; enzymes such as lipase, amylase, cellulase and protease; optical brighteners such as stilbene derivatives; sequestrants or a combination of sequestrants with low affinity for cobalt but which will complex with other transition metals or if not, at a low enough level not to impair catalyst performance, and flow aids/fillers such as sodium sulphate.

Typically for detergent formulations according to the invention, assuming a typical usage level of detergent of 5 g/l (Europe), a suitable level of cobalt chloride hexahydrate and, for example, a mannosamine ligand in the detergent formulation would be in the order of 0.024 wt % and 1.08 wt % respectively.

In use the cobalt level may for example be in the range from 0.85 to 85 $\mu$moles Co/liter of wash liquor (0.05 to 5 ppm).

More detailed information on typical detergent compositions is disclosed in, for example, WO 92/06161.

The invention is further described in the following Examples.

EXAMPLE 1

Comparison of tea stain bleaching performance of mixed cobalt salt/organic polyol/persalt systems with organically activated persalts at 40° C.

Test wash liquor was prepared composed of 1 liter of deionised water to which was added as appropriate:

(a) $5\times10^{-6}$ M $CoCl_2.6H_2O$ ($CoCl_2.6H_2O$)

(b) $8.6\times10^{-3}$ M $H_2O_2$, as peroxygen source to provide active oxygen in solution, and $8.6\times10^{-3}$ M sodium metaborate, as borate buffer to simulate use of sodium perborate (PBS), (c) $8.6\times10^{-3}$ M $H_2O_2$, as peroxygen source, and $5.7\times10^{-3}$ M sodium carbonate as carbonate buffer to simulate sodium percarbonate (PCS), (d) $6.6\times10^{-4}$ M tetraacetylethylenediamine (TAED), as an activator, (e) $2.5\times10^{-4}$ M of the specified polyhydroxy compound to provide a bleach system as set out in Table I below.

Bleaching tests were carried out in a Terg-o-tometer (United States Testing Co.) at 40° C. The pH was monitored and maintained at 10 using dilute sulphuric acid or sodium hydroxide solution as necessary.

Four 10×10 $cm^2$ swatches of tea stained cotton (BC1) were used in the bleaching studies.

The wash duration was 31 minutes.

The reflectance of all swatches was measured before and after washing on a HunterLab UltraScan XE spectrophotometer. The change in reflectance of the washed and unwashed cloths ($\Delta R$) was calculated at the stated wavelength and the four $\Delta R$ values were averaged to give an overall value per wash.

The results are shown in Table I below.

TABLE I

| Bleach System | $\Delta R_{460}$ |
|---|---|
| PBS | 6.27 |
| PBS + TAED | 8.40 |
| PCS | 7.18 |
| PCS + TAED | 7.90 |
| PBS + $CoCl_2.6H_2O$ | 9.86 |
| PCS + $CoCl_2.6H_2O$ | 11.75 |
| PBS + $CoCl_2.6H_2O$ + D-mannosamine | 10.25 |
| PCS + $CoCl_2.6H_2O$ + D-mannosamine | 11.89 |
| PBS + $CoCl_2.6H_2O$ + Simulsol SL 10* | 11.81 |
| PCS + $CoCl_2.6H_2O$ + Simulsol SL 10 | 11.23 |
| PBS + $CoCl_2.6H_2O$ + D-glucosamine | 9.84 |
| PCS + $CoCl_2.6H_2O$ + D-glucosamine | 10.96 |
| PBS + $CoCl_2.6H_2O$ + D-galactosamine | 10.27 |
| PCS + $CoCl_2.6H_2O$ + D-galactosamine | 10.71 |

Hydrolytic stability tests were carried out at a mole ratio of 10 ligand:1$Co^{2+}$ as $CoCl_2.6H_2O$ (0.5 mmol ligand/0.05 mmol $Co^{2+}$). Where indicated, PBS was added as $8.6\times10^{-3}$ M sodium metaborate and $8.6\times10^{-3}$ M $H_2O_2$, and PCS as $5.7\times10^{-3}$ M sodium carbonate and $8.6\times10^{-3}$ M $H_2O_2$. The test solutions were prepared in deionised water and all solutions were adjusted to pH 10 before the addition of the Co.

The results are shown in Table II below.

TABLE II

| Solution Composition | Stable* after 1 hour | Stable* after 24 hours |
|---|---|---|
| $CoCl_2.6H_2O$ | yes | no |
| $CoCl_2.6H_2O$ + PBS | yes | no |
| $CoCl_2.6H_2O$ + PCS | yes | no |
| $CoCl_2.6H_2O$ + D-mannosamine + PBS | yes | yes |
| $CoCl_2.6H_2O$ + D-mannosamine + PCS | yes | yes |
| $CoCl_2.6H_2O$ + Simulsol SL 10 + PBS | yes | yes |
| $CoCl_2.6H_2O$ + Simulsol SL 10 + PCS | yes | yes |
| $CoCl_2.6H_2O$ + D-glucosamine + PBS | yes | yes |
| $CoCl_2.6H_2O$ + D-glucosamine + PCS | yes | yes |
| $CoCl_2.6H_2O$ + D-galactosamine + PBS | yes | yes |
| $CoCl_2.6H_2O$ + D-galactosamine + PCS | yes | yes |

*Stable solutions are defined as optically transparent and containing no visible precipitate

EXAMPLE 2

Comparison of tea stain bleaching performance of mixed cobalt salt/organic polyol/persalt systems with organically activated persalts at 20° C., 30° C. and 40° C.

Test wash liquors were prepared, as in Example 1, to provide bleach systems as set out in Table III below.

Bleaching test and reflectance measurements were carried out as in Example 1, except that the bleaching test temperatures used were 20° C., 30° C. and 40° C.

The results are shown in Table III below.

TABLE III

| | $\Delta R_{460}$ | | |
|---|---|---|---|
| Bleach System | 20° C. | 30° C. | 40° C. |
| PBS | 2.98 | — | 6.27 |
| PBS + TAED | 4.53 | 7.00 | 8.40 |
| PBS + $CoCl_2.6H_2O$ | 5.35 | — | 9.86 |
| PBS + $CoCl_2.6H_2O$ + D-mannosamine | 4.69 | 7.85 | 10.25 |
| PBS + $CoCl_2.6H_2O$ + Simulsol SL 10 | 6.29 | 8.08 | 11.81 |

EXAMPLE 3

Effect of peroxide and cobalt salt concentration upon tea stain bleaching performance at 40° C.

Test wash liquor was prepared composed of 1 liter of deionised water to which was added, as appropriate:

(a) $5\times10^{-6}$ or $10\times10^{-6}$ M $CoCl_2.6H_2O$ (b) $8.6\times10^{-3}$ M $H_2O_2$ and $8.6\times10^{-3}$ sodium metaborate or $17.2\times10^{-3}$ M $H_2O_2$ and $17.2\times10^{-3}$ M sodium metaborate (c) $6.6\times10^{-4}$ M tetraacetylethylenediamine (TAED)

(d) $2.5\times10^{-4}$ M of the specified polyhydroxy compound to provide the bleach system as set out in Table IV below.

Bleaching tests and reflectance measurements were carried out as in Example 1.

The results are shown in Table IV below.

TABLE IV

| TAED or Polyhydroxy Compound present | $[CoCl_2.6H_2O]/\times10^{-6}$ M | $[H_2O_2]$ (in borate buffer)/ $\times10^{-3}$ M | $\Delta R_{460}$ |
|---|---|---|---|
| TAED | 0 | 8.6 | 8.40 |
| none | 5 | 8.6 | 9.86 |
| D-mannosamine | 5 | 8.6 | 10.25 |
| Simulsol SL 10 | 5 | 8.6 | 11.81 |
| D-mannosamine | 10 | 8.6 | 12.55 |
| Simulsol SL 10 | 10 | 8.6 | 11.27 |
| TAED | 0 | 17.2 | 11.54 |
| none | 5 | 17.2 | 15.50* |
| D-mannosamine | 5 | 17.2 | 16.72 |
| Simulsol SL 10 | 5 | 17.2 | 13.62 |
| D-galactosamine | 5 | 17.2 | 13.24 |

*A high reflectance value was obtained from the wash containing Co (5 × 10−6 M) + $H_2O_2$ (17.2 mmol), however this combination would be unacceptable under laundry conditions due to its hydrolytic instability.

EXAMPLE 4

Comparison of performance of PBS with and without addition of Co salt/Simulsol SL 10 complex against a variety of stains and soils in washing tests at 40° C.

Test wash liquor was prepared composed of 1 liter of deionised water to which was added, as appropriate (a) $8.6\times10^{-3}$ M $H_2O_2$ and $8.6\times10^{-3}$ M sodium metaborate (PBS), (b) $6.6\times10^{-4}$ M TAED, (c) $5\times10^{-6}$ M $CoCl_2.6H_2O$, (d) $2.5\times10^{-4}$ M Simulsol SL 10 to provide a bleach composition as set out in Table V below.

Bleaching tests were carried out using four 10×10 $cm^2$ swatches of each of the indicated samples.

The protocol for the bleaching and bleaching/cleaning studies was as the bleaching tests of Example 1.

Reflectance was measured as described in Example 1.

The results obtained were as in Table V below.

TABLE V

| | $\Delta R_{460}$ | | | | |
|---|---|---|---|---|---|
| Bleach Composition | EMPA 114[a] | BC1[b] | BC2[c] | CS-5S[d] | EMPA 101[e] |
| PBS/TAED | 24.15 | 8.40 | 7.71 | 6.91 | 18.04 |
| PBS + $CoCl_2.6H_2O$ + Simulsol SL 10 | 22.37 | 11.81 | 9.12 | 5.59 | 23.21 |

[a]EMPA 114 = red wine stained cotton
[b]BC1 = tea stained cotton
[c]BC2 = coffee stained cotton
[d]CS-5S = mayonnaise/annatto soiled cotton
[e]EMPA 101 = carbon black/olive oil soiled cotton

What is claimed is:

1. A method for catalyzing bleaching comprising adding an effective amount of a water-soluble complex of (a) one or more cobalt ions and, as ligand, (b) one or more aminated and/or alkylated mono- or oligo-saccharides, optionally in reduced or oxidized form, and salts thereof, to a cleaning or detergent composition comprising a bleaching agent.

2. A method for catalyzing bleaching according to claim 1 wherein, in the complex, the cobalt ion(s) (a) is/are complexed with (b) one or more compounds of the general formula I (I)

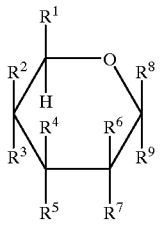

wherein $R^1$ is selected from $CH_2OH$, $CO_2H$, $CO_2$ M (wherein M is an alkali metal or ammonium ion) and groups of the formula (a) to (d)

(a)

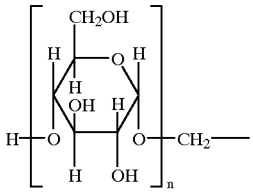

(b)

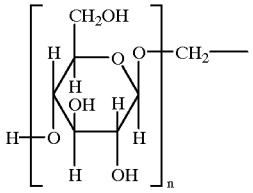

(c)

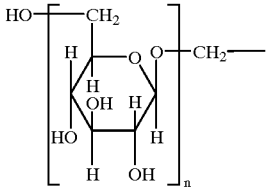

(d)

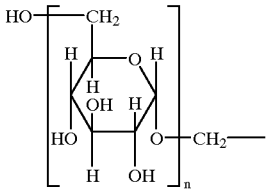

and n is an integer from 1 to 3;

one of $R^2$ and $R^3$ is H and the other is selected from H, OH and groups of the formula (e) to (h)

(e)

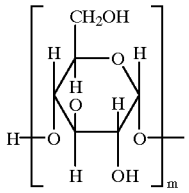

-continued (f)

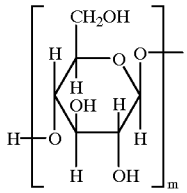

(g)

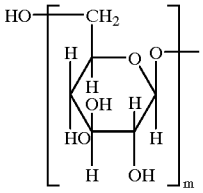

(h)

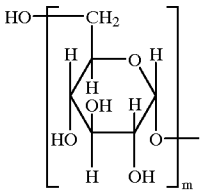

and m is an integer from 1 to 3;

one of $R^4$ and $R^5$ is H and the other is OH;

one of $R^6$ and $R^7$ is H and the other is OH or $NH_2$; and one of $R^8$ and $R^9$ is H and the other is OH, $OCH_2(CH_2)_2)_p$ $CH_3$ (wherein p is an integer from 6 to 16), or a group of the formula

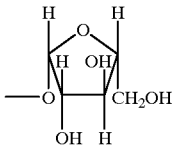

provided that one of $R^6$ and $R^7$ is $NH_2$ and/or one of $R^8$ and $R^9$ is $OCH_2(CH_2)_pCH_3$.

3. A method for catalyzing bleaching according to claim 1 wherein, in the complex, the cobalt ion(s) (a) is/are complexed with (b) one or more compounds of the general formula II (II)

$$R^{10}[C_lH_{2l-k}(OH)_k]\underset{\underset{NH_2}{|}}{C}HR^{11}$$

wherein each of $R^{10}$ and $R^{11}$, which may be the same or different, represents H, $CH_2OH$, $CO_2H$ or $CO_2$ M (wherein M is as defined above); and each of 1 and k is an integer of 2 to 5 and k is equal to or less than 1.

4. A method for catalyzing bleaching according to claim 1 wherein, in the complex, the cobalt ion(s) (a) is/are complexed with D-mannosamine, D-glucosamine, or D-galactosamine.

5. A method for catalyzing bleaching according to claim 1 wherein, in the complex, the cobalt ion(s) (a) is/are complexed with (b) one or more alkyl polyglucosides having a degree of polymerisation up to 5 and wherein the alkyl groups contain 8 to 18 carbon atoms.

6. A method for catalyzing bleaching according to claim 1 wherein, in the complex, the or each cobalt ion (a) is a Co(II) or Co(III) ion.

7. A cleaning or detergent composition comprising (I) a bleaching agent, and (II) as bleach catalyst, a water-soluble complex as defined in claim 1.

8. A cleaning or detergent composition comprising:

(I) a bleaching agent, and, as precursors for a bleach catalyst (IIA) a water-soluble compound capable of releasing Co(II) or Co(III) ions on addition to water, and (IIB) one or more aminated mono- or oligo-saccharides, optionally in reduced or oxidised form, and salts thereof.

9. A composition according to claim 8 wherein there is used as component (IIA) cobalt chloride.

10. A composition according to claim 8 wherein there is used as component (IIB) one or more compounds of the general formula I (I)

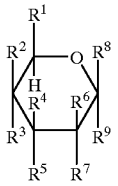

wherein $R^1$ is selected from $CH_2OH$, $CO_2H$, $CO_2$ M wherein M is an alkali metal or ammonium ion) and groups of the formula (a) to (d)

(a)

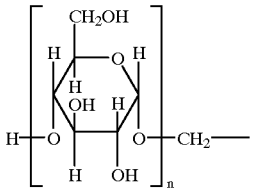

(b)

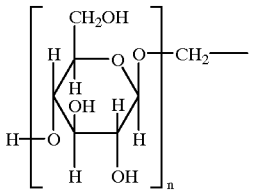

(c)

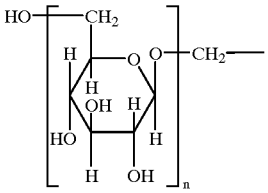

-continued (d)

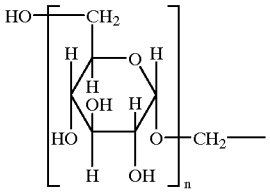

and n is an integer from 1 to 3;

one of $R^2$ and $R^3$ is H and the other is selected from H, OH and groups of the formula (e) to (h)

(e)

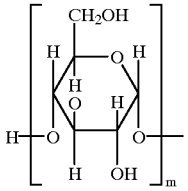

(f)

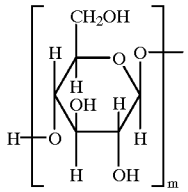

(g)

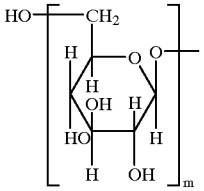

(h)

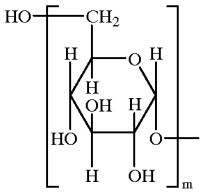

and m is an integer from 1 to 3;

one of $R^4$ and $R^5$ is H and the other is OH;

one of $R^6$ and $R^7$ is H and the other is $NH_2$; and one of $R^8$ and $R^9$ is H and the other is OH or a group of the formula

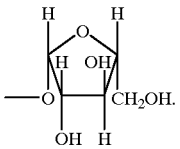

11. A composition according to claim 8 wherein there is used as component (IIB) one or more compounds of the general formula II (II)

$$R^{10}[C_1H_{21-k}(OH)_k]CHR^{11}$$
$$\quad\quad\quad\quad\quad\quad\quad\quad |$$
$$\quad\quad\quad\quad\quad\quad\quad\quad NH_2$$

wherein each of $R^{10}$ and $R^{11}$, which may be the same or different, represents H, $CH_2OH$, $CO_2H$ or $CO_2^{\ominus}M^{\oplus}$ (wherein M is as defined above); and each of 1 and k is an integer of 2 to 5 and k is equal to or less than 1.

12. A composition according to claim 8 wherein there is used as component (IIB) D-mannosamine, D-glucosamine, or D-galactosamine.

13. A composition according to claim 7 wherein the water-soluble complex comprises cobalt ion(s) complexed with one or more alkyl polyglucosides having a degree of polymerisation up to 5 and wherein the alkyl groups contain 8 to 18 carbon atoms.

14. A composition according to any one of claims 7–13 wherein the bleaching agent (I) is a peroxy compound which liberates hydrogen peroxide in water.

15. A composition according claim 14 wherein the peroxy compound is sodium perborate or sodium percarbonate.

* * * * *